US005811927A

United States Patent [19]

Anderson et al.

[11] Patent Number: 5,811,927

[45] Date of Patent: Sep. 22, 1998

[54] METHOD FOR AFFIXING SPACERS WITHIN A FLAT PANEL DISPLAY

[75] Inventors: Clifford L. Anderson, Tempe; Curtis D. Moyer, Phoenix, both of Ariz.

[73] Assignee: Motorola, Inc., Schaumburg, Ill.

[21] Appl. No.: 667,556

[22] Filed: Jun. 21, 1996

[51] Int. Cl.[6] ..... H01J 9/24

[52] U.S. Cl. ..... 313/495; 445/24

[58] Field of Search ..... 445/24; 313/495, 313/309

[56] References Cited

U.S. PATENT DOCUMENTS 5,232,549 8/1993 Cathey et al. .
5,717,287 2/1998 Amrine et al. ..... 445/24

FOREIGN PATENT DOCUMENTS 0616354 2/1994 European Pat. Off. .

OTHER PUBLICATIONS

Cathryn E. Goodman et al., "A Novel Multichip Module Assembly Approach Using Gold Ball Flip–Chip Bonding", *IEEE Transactions On Components, Hybrids, And Manufacturing Technology, vol. 15, No. 4,* Aug. 1992, pp. 457–464.

*Primary Examiner*—Kenneth J. Ramsey
*Attorney, Agent, or Firm*—Kathleen Anne Tobin; Eugene A. Parsons

[57] ABSTRACT

A method for affixing a plurality of spacers (102) within a field emission display (160) is disclosed. The method includes the steps of: (i) providing a plurality of members (104), (ii) coating an edge (106) of each of the plurality of members (104) with a metal to provide a bonding layer (108), (iii) forming a metallic bonding pad (132) on the inner surface of an anode (120) to provide a modified anode (130), (iv) affixing a plurality of metallic compliant members (112) to the bonding layer (108) by using ball bonding techniques, and (v) affixing the metallic compliant members (112) to the metallic bonding pad (132), while positioning the spacer (102) perpendicularly with respect to the modified anode (130), by using thermocompression metal bonding techniques.

25 Claims, 8 Drawing Sheets

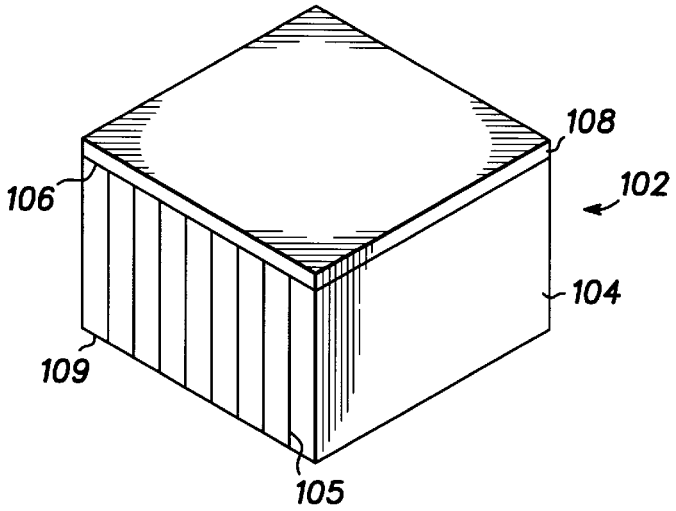
FIG. 1
100
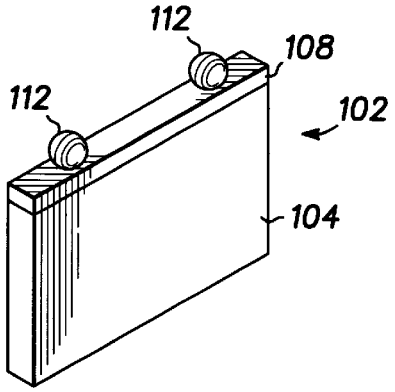
FIG. 2
110
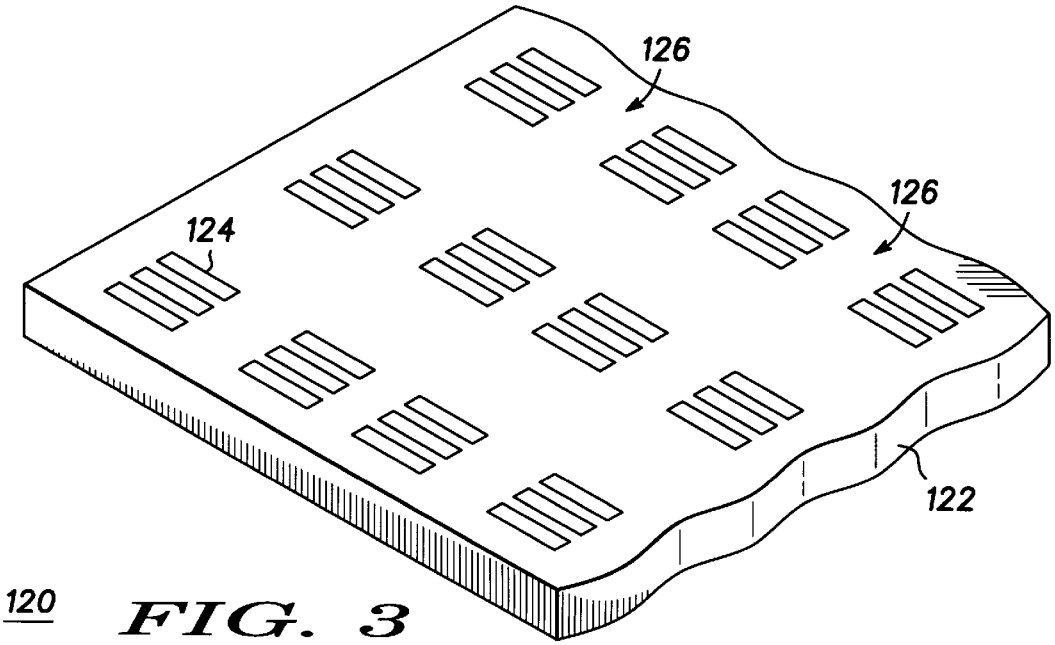
120 FIG. 3

- PRIOR ART -

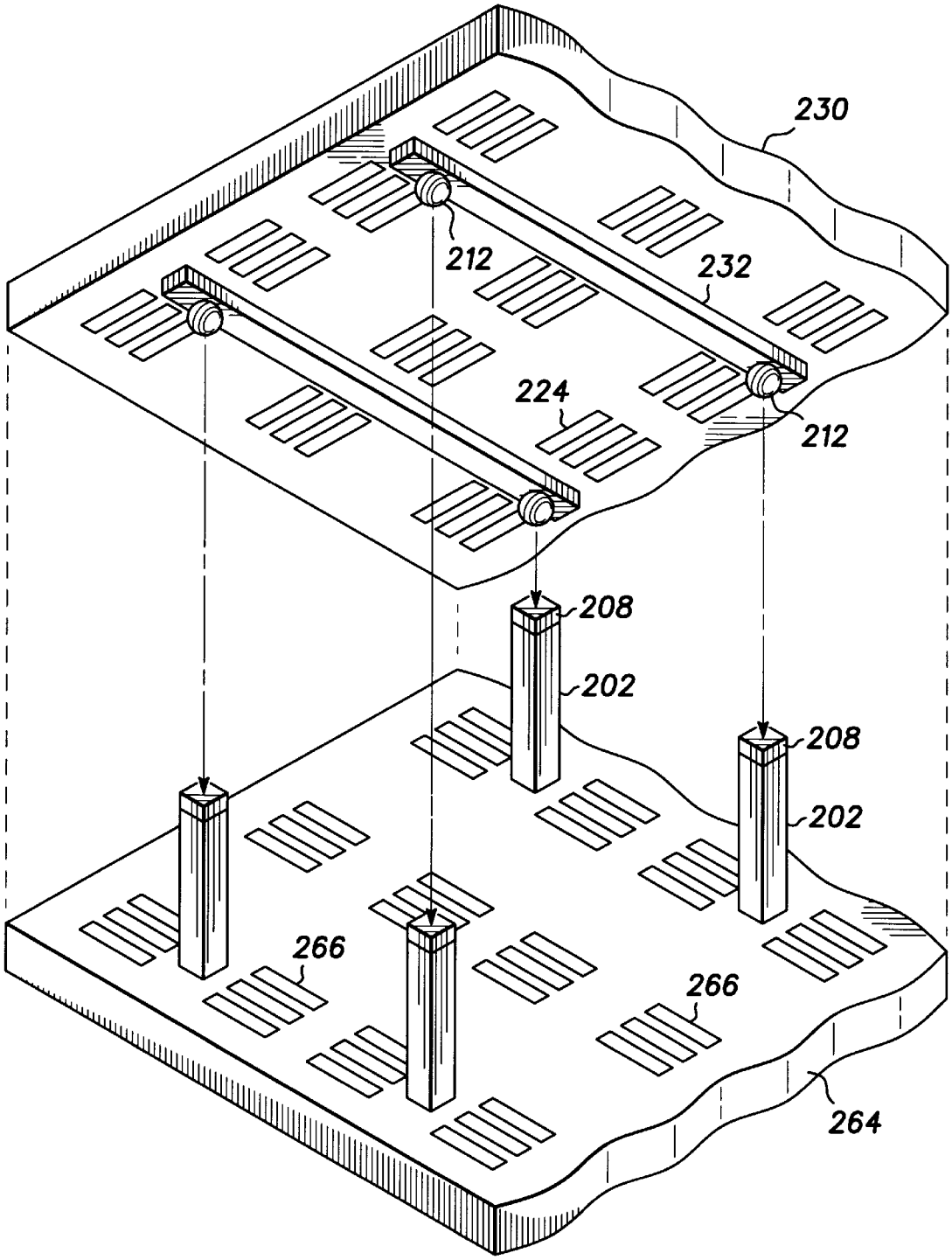
260 FIG. 14

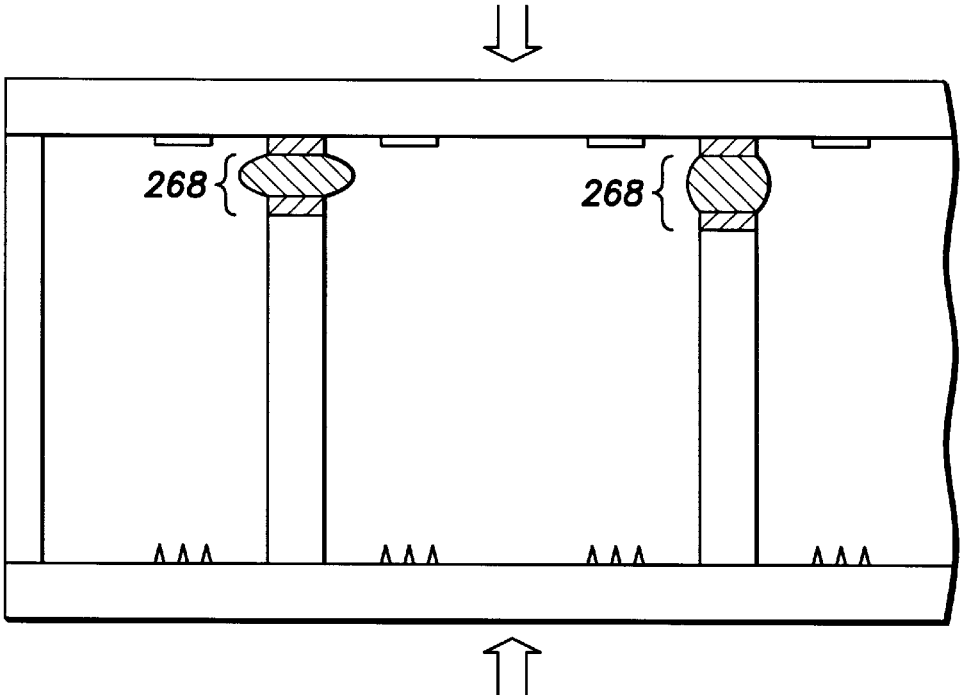
260 FIG. 16
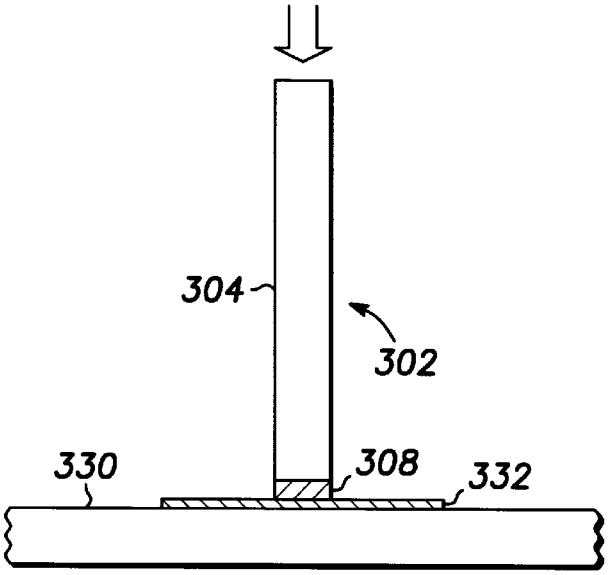
350 FIG. 17

METHOD FOR AFFIXING SPACERS WITHIN A FLAT PANEL DISPLAY

FIELD OF THE INVENTION

The present invention pertains to a method for providing spacers in a flat panel display and more specifically to a method for using metal-to-metal bonding to affix spacers to a display plate of a flat panel display.

BACKGROUND OF THE INVENTION

Spacers for flat panel displays, such as field emission displays, are known in the art. A field emission display includes an envelope structure having an evacuated interspace region between two display plates. Electrons travel across the interspace region from a cathode plate (also known as a cathode or back plate), upon which electron-emitter structures, such as Spindt tips, are fabricated, to an anode plate (also known as an anode or face plate), which includes deposits of light-emitting materials, or "phosphors". Typically, the pressure within the evacuated interspace region between the cathode and anode plates is on the order of 10-6 Torr.

The cathode plate and anode plate are thin in order to provide low display weight. If the display area is small, such as in a 1" diagonal display, and a typical sheet of glass having a thickness of about 0.04" is utilized for the plates, the display will not collapse or bow significantly. However, as the display area increases, the thin plates are not sufficient to withstand the pressure differential in order to prevent collapse or bowing upon evacuation of the interspace region. For example, a screen having a 30" diagonal will have several tons of atmospheric force exerted upon it. As a result of this tremendous pressure, spacers play an essential role in large area, light-weight displays. Spacers are structures being incorporated between the anode and the cathode plate. The spacers, in conjunction with the thin, lightweight, plates, support the atmospheric pressure, allowing the display area to be increased with little or no increase in plate thickness.

Several schemes have been proposed for providing spacers. Some of these schemes include the affixation of structural members to the inner surface of one of the display plates. In one such prior art scheme, glass rods or posts are affixed to one of the display plates by applying devitrifying solder glass frit to one end of the rod or post and bonding the frit to the inner surface of one of the display plates. This scheme includes problems such as bond brittleness, particulate contamination, smearing onto pixels, nonuniformity of spacer height of the fritted spacer due to initial height variations in the rods or posts, and non-perpendicularity due to displacements during cooling of the frit. Other proposed schemes for bonding spacers onto a display plate include the use of organic glues. However, organic glues are burned off before the package has been sealed and differential pressure applied thereby predisposing the spacers to being loosened or misplaced within the envelope of the display.

Spacers for field emission displays must support the differential pressure load reasonably equally among the plurality of spacers. Otherwise, unequal load distribution can cause breakage of spacers or breakage of the display plates. This will introduce debris within the display or completely destroy the display. One of the problems inherent in the fabrication of spacers is the variation in height of the structural member due to error in the processes for fabricating the structural members. However, uniformity of the load-bearing spacer height is required. A tight tolerance in spacer height is required to assure uniform load distribution among the plurality of spacers.

Another problem with prior art schemes for providing spacers is the potentially deleterious effect of particulate contamination. If the edge of a spacer contacts a contaminant particle within the display, loading is concentrated at the point of contact with the particle. This results in stress risers in the spacer and possible breakage.

Thus, there exists a need for a method for affixing spacers within a flat panel display which can provide substantially uniform load distribution among the spacers, which is compatible with the temperatures of subsequent processing steps, and which is compatible with the clean, high vacuum environment within a field emission display.

BRIEF DESCRIPTION OF THE DRAWINGS

Referring to the drawings:

FIGS. 1 and 2 are isometric views of structures realized by performing various steps of an embodiment of a method for affixing spacers in a flat panel display in accordance with the present invention.

FIGS. 3 and 4 are isometric and cross-sectional views, respectively, of a standard anode.

FIGS. 13 and 14 are isometric views of structures realized by performing various steps of another embodiment of a method for affixing spacers in a flat panel display in accordance with the present invention.

FIG. 16 is a cross-sectional view of a structure realized by performing various steps upon the structure depicted in FIG. 15 in accordance with the present invention.

FIG. 17 is a cross-sectional view of a structure realized by performing various steps of another embodiment of a method for affixing spacers in a flat panel display in accordance with the present invention.

DESCRIPTION OF THE PREFERRED EMBODIMENT

Figure 4:
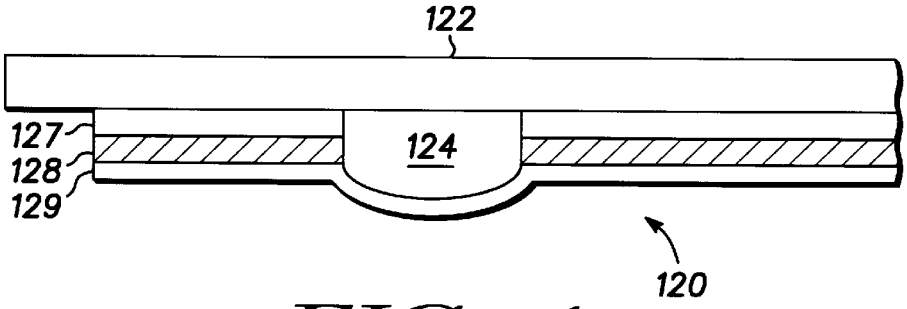

Referring now to FIG. 1, there is depicted an isometric view of a structure 100 realized by performing various steps of a preferred embodiment of a method for affixing spacers 102 in a flat panel display in accordance with the present invention. Structure 100 is made by first providing a plurality of members 104. Members 104 have a substantially uniform height and a length within a range of about 1–100 millimeters. The uniform height is within a range of 0.1–3 millimeters and depends upon the predetermined height between the display plates of the flat panel display. Good height uniformity among the plurality of members 104 is desired so that uniform loading of spacers 102 can be achieved within the flat panel display, but typically there is a variation in the height of members 104 within a range of about 1–5 micrometers. However, known methods for affixing members 104 do not offer enough compliance to compensate for the height variability between individual members 104; for example, glass spacers attached with frit provide only about 0.1 micrometers of compliance under the standard loading conditions of a spacer within a field emission display. Embodiments of a method in accordance with the present invention provide adequate compliance so that spacer uniformity is achieved, for a height tolerance of up to 35 micrometers in members 104. Members 104 have a width within a range of 25–250 micrometers. The width depends upon the dimensions of the space available, such as between pixels, for placement of spacers 102. Members 104 are made from a dielectric material, which, in the preferred embodiment, includes a ceramic. Other suitable dialectric materials may be used, such as glass-ceramic, glass, or quartz. In this particular embodiment, a sheet of ceramic is cut into pieces, such as ribs, thereby forming members 104. In the preferred embodiment, spacers 102 are flat structures; however, in other embodiments of a method in accordance with the present invention, spacers 102 have other shapes. The cutting can be performed by using one of several available precision saws, such as a diamond saw, supplied by companies such as Norton and Manufacturing Technology, Inc. In the preferred embodiment of the method, members 104 have a height of 1 millimeter, a width of 0.1 millimeters, and a length of 5 millimeters. These dimensions depend upon the predetermined spacing between the display plates, the dimensions of the space available for spacer placement on the inner surfaces of the display plates, and the load-bearing requirements of each spacer 102, respectively. In the preferred embodiment, members 104 include a borosilicate-alumina material in the form of a tape, having a thickness of 0.1 millimeters, the tape having been fired and lapped in a two-sided lapping machine. Such a tape is supplied by DuPont. After members 104 are provided, they are stacked together so that their lateral surfaces 105 are in abutting engagement and so that their edges 106 are exposed. Edges 106 of members 104 are then coated with a suitable metal to provide a bonding layer 108. The coating step can be performed by inserting members 104 in a spring-loaded mask fixture, which holds members 104 in place and prevents the coating of other portions of members 104, other than edges 106. Edges 106 are coated by any of a number of standard deposition techniques, including vacuum deposition. In this particular embodiment, bonding layer 108 is made from gold and is 0.3–2 micrometers thick. In other embodiments of a method in accordance with the present invention, other metals, such as aluminum, are deposited on edges 106; the thickness of bonding layer 108 depends on the type of metal employed and the type of metal to which it is subsequently bonded. The metal comprising bonding layer 108 must be suitable for forming a metal-to-metal bond by one of a number of standard methods, such as thermocompression bonding, ultrasonic bonding, and thermosonic bonding. Structure 100 is then separated into individual, coated spacers 102 by fracturing bonding layer 108 at the locations which are in registration with lateral surfaces 105. In another embodiment of the present method, before the step of separating structure 100 into spacers 102, opposed edges 109 of members 104 are metallized in a similar manner, so that metal-to-metal bonding can be made at edges 109 as well.

Referring now to FIG. 2 there is depicted an isometric view of a structure 110 realized by performing various steps of an embodiment of a method for affixing spacers in a flat panel display in accordance with the present invention. Structure 110 includes spacer 102 and two metallic compliant members 112, which are affixed to bonding layer 108 of spacer 102 via metal-to-metal bonds. In other embodiments of the present invention, only one metallic compliant member, or more than two metallic compliant members, may be employed. Metallic compliant members 112 include a metal having a low yield strength, thereby providing a material having suitable compliance to provide uniform spacing between the display plates of the flat panel display, as will be described in greater detail below. Metallic compliant members 112 also have a geometry which facilitates metal-to-metal bonding. The geometry of metallic compliant members 112 affects the amount of force required to create metallic bonds formed with them; it also affects the yield rate of metallic compliant members 112, a favorable value for which will provide the desired compliance of metallic compliant members 112. In this particular embodiment, metallic compliant members 112 include essentially spherical balls. The use of essentially round wire or spherical balls is beneficial since these shapes result in a bonding force which is low and can prevent breakage of spacers 102 during bonding steps, and the yield force, or force sufficient to cause plastic deformation, is low enough to provide sufficient deformation of metallic compliant members 112 to accommodate the height tolerances typically encountered in members 104. In this particular embodiment, metallic compliant members 112 are made from a gold alloy which includes 1–2% palladium. In other embodiments of a method in accordance with the present invention, metallic compliant members 112 are made from essentially pure gold. When a ball is detached from the wire during ball-bonding, a break-off tail is formed. The gold-palladium alloys provides the benefit of a break-off tail which is more uniform and breaks just above the ball. In this particular embodiment, metallic compliant members 112 are formed on, and bonded to, bonding layer 108 by using one of a number of standard gold ball-bonding machines, such as those produced by Hybond, K&S, and Hughes. The gold is supplied via 0.7 mil gold wire, such as supplied by Hydrostatics or American Fine Wire. The standard gold wire bonding equipment is used to place gold balls on bonding layer 108 and affixed by one of various metal compression bonding techniques. Gold has a suitably low yield strength so that compliance is achieved without breaking spacers 102. Metallic compliant members 112 include gold balls having diameters of about 75 micrometers so that they will be accommodated, in their post-bonding geometry, within the available space between pixel rows of a display plate of a field emission display. In other embodiments of the present method, ball bonds having differing sizes are used, depending on the dimensions of the available space for bonding. The size of the ball may be varied by varying the diameter of the wire from which the balls are made.

In other embodiments of a method in accordance with the present invention, metallic compliant members 112 include deposits of metal being formed on members 104. The deposits can be shaped hemispherically or in an otherwise similarly shaped pedestal. The pedestals can be deposited by selectively electroplating gold onto a bonding layer. The bonding layer includes an adhesion layer which is formed on the edge of member 104 and a seed layer which is formed on the adhesion layer. The adhesion layer includes a suitable metal such as titanium, and the seed layer is made from a suitable seeding material such as gold. Metallic compliant members 112 can also include metal structures grown on edges 106 by selectively plating a metal via electroless plating solutions. Metallic compliant members 112 can also be provided by shadow mask deposition or by a patterned etch process.

Referring now to FIGS. 3 and 4 there are depicted isometric and cross-sectional views, respectively, of a portion of a standard anode 120 for a field emission display. Anode 120 includes a transparent plate 122, which is typically made of glass. Anode 120 further includes a plurality of pixels 124 which include deposits of a light-emitting material, such as a cathodoluminescent material, or phosphor. Pixels 124 are arranged in an array including rows and columns. A plurality of regions 126 exist between the rows and columns of pixels 124. Regions 126 are available for making physical contact with spacers so that a predetermined spacing can be maintained between anode 120 and the cathode display plate, without interfering with the light-emitting function of the display. FIG. 4 depicts a cross-sectional view of anode 120, taken through one of pixels 124. Typically, anode 120 includes layers 127, 128, 129 being formed on its inner surface. Layer 127 includes chromium oxide; layer 128 includes chromium; and layer 129 includes a thin layer of aluminum which is about 700 angstroms thick and which serves as an optical reflector. A metallic compliant member which includes a wire of aluminum can be ultrasonically bonded to layers 128 and 129. However, metallic compliant members 112, including the gold balls, do not bond adequately to layer 129 via thermocompression techniques; layer 129 does not have sufficient thickness for forming a thermocompression metallic bond with metallic compliant members 112. However, if the metallic compliant members include aluminum wire, they can be ultrasonically bonded to layer 129. The disadvantage of this method is that wire ends can be left hanging in the display envelope. Additionally, layer 129 is not included in all field emission displays; it is only included in high-voltage field emission displays which can withstand the loss of electrical potential that occurs when emitted electrons traverse layer 129 before arriving at the phosphors deposits. In order to affix structure 110 of FIG. 2 to the anode of a field emission display, standard anode 120 requires modifications, which are described in greater detail below with reference to FIGS. 5 and 6.

Figure 5:
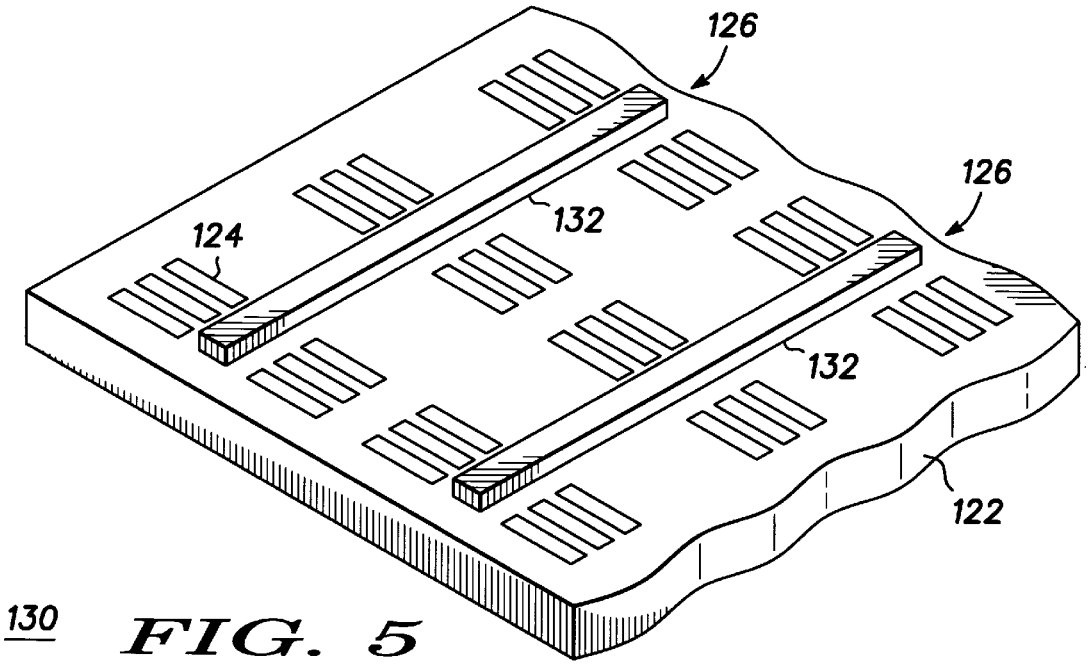
FIG. 5 is an isometric view of an anode realized by performing various steps of an embodiment of a method for affixing spacers in a flat panel display in accordance with the present invention.

Referring now to FIG. 5, there is depicted an isometric view of a modified anode 130 realized by performing various steps of an embodiment of a method for affixing spacers 102 in a flat panel display, in accordance with the present invention. Modified anode 130 includes a plurality of metallic bonding pads 132, which are disposed between pixels 124 at the locations where spacers 102 are to be affixed. An adequate layout of spacers 102 throughout the field emission display is predetermined to provide sufficient structural support between modified anode 130 and the cathode plate. In this particular embodiment, metallic bonding pads 132 include strips of aluminum being deposited between rows of pixels 124. Also, modified anode 130 includes transparent plate 122 being made from a glass plate having a thickness of 1.1 millimeter so that the pitch of metallic bonding pads is about 15 millimeters. Transparent plates having other dimensions may be used, thereby requiring different spacer layouts. Metallic bonding pads 132 are deposited by one of a number of suitable deposition methods, such as sputtering while providing a suitable mask. Metallic bonding pads 132 have a thickness of about 2 micrometers and a width of about 100 micrometers.

Figure 6:
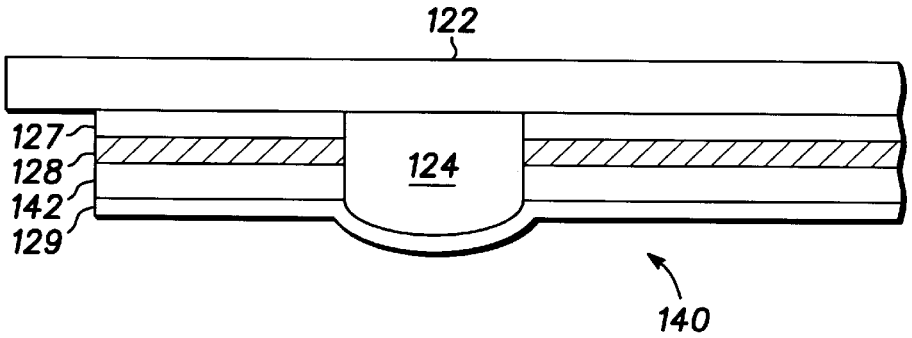
FIG. 6 is a cross-sectional view, similar to FIG. 4, of an anode realized by performing various steps of another embodiment of a method in accordance with the present invention.

Referring now to FIG. 6 there is depicted a cross-sectional view, similar to FIG. 4, of an anode 140 realized by performing various steps of another embodiment of a method in accordance with the present invention. In this particular embodiment, a metallic bonding pad 142 is disposed at all regions 126, so that metallic compliant members 112 can be bonded anywhere within regions 126 between pixels 124. Anode 140 is made by first depositing upon transparent plate 122 a layer of chromium oxide, a layer of chromium, and, then, depositing a layer of aluminum having a thickness of about 10,000 Angstroms. Then, holes are formed, using etching techniques, through the chromium oxide, chromium, and aluminum layers at the desired locations for the phosphor deposits of pixels 124, thereby providing layers 127, 128, and metallic bonding pad 142. In high-voltage field emission displays, layer 129, including a thin layer of aluminum having a thickness of about 700 angstroms, is then deposited over the entire inner surface. Metallic bonding pad 142 must be thick enough so that metallic compliant members 112 of structure 110 (FIG. 2) can form a suitable metallic bond with metallic bonding pad 142. In an another embodiment of a method in accordance with the present invention, a metallic bonding pad can be applied by utilizing the selective deposition mask used for depositing the chromium of layer 128.

Figure 7:
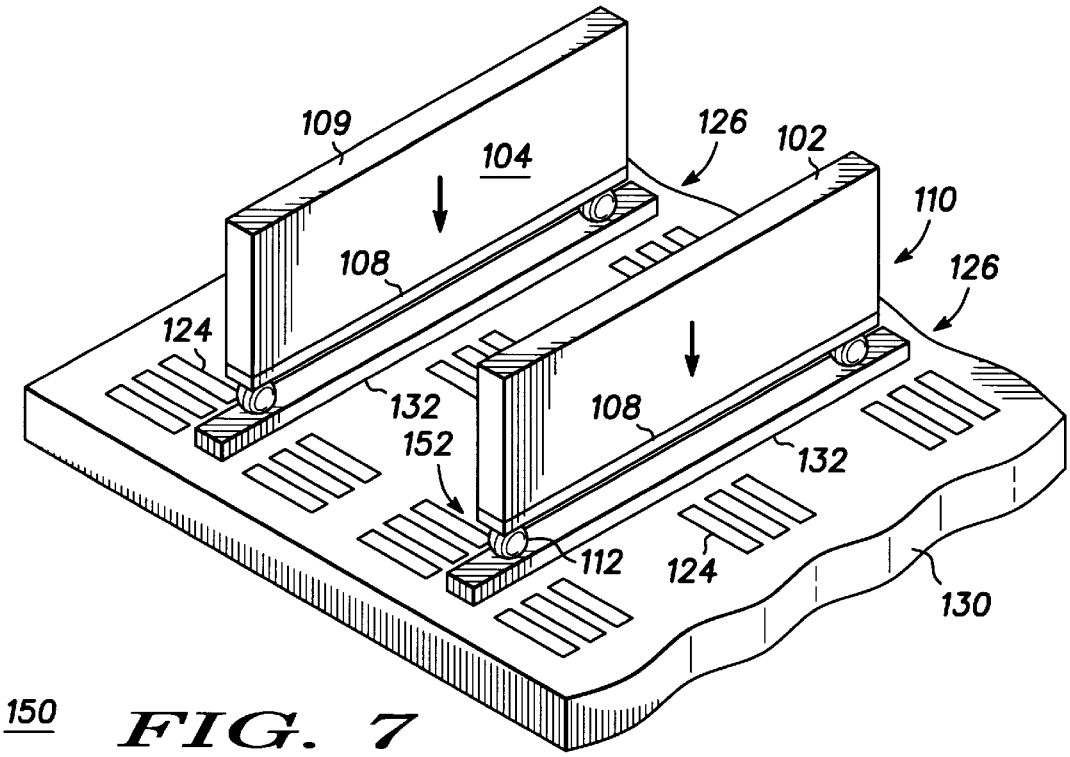
FIG. 7 is an isometric view of a structure realized by affixing the structure of FIG. 2 to the structure of FIG. 5 by performing various steps of an embodiment of a method in accordance with the present invention.

Referring now to FIG. 7, there is depicted an isometric view of a structure 150 realized by affixing several of structures 110 (FIG. 2) to a portion of modified anode 130 (FIG. 5) by performing various steps of an embodiment of a method for affixing spacers in a flat panel display in accordance with the present invention. Within structure 150, metallic compliant members 112 are affixed to portions of metallic bonding pads 132, thereby affixing spacers 102 to modified anode 130, so that spacers 102 remain in a perpendicular orientation with respect to the inner surface of modified anode 130 during subsequent packaging steps in the fabrication of the flat panel display. The metallic bond between metallic compliant members 112 and metallic bonding pads 132 can be formed by one of a number of standard metal-to-metal bonding techniques, such as thermocompression bonding, thermosonic bonding, ultrasonic bonding, and the like. In this particular embodiment, a thermocompression bonding machine is used. Structures 110 are placed in a heated fixture wherein a vacuum is used to hold structures 110 in a perpendicular orientation with respect to modified anode 130 and to place metallic compliant members 112 in physical contact with metallic bonding pads 132, thereby providing a compliant region 152, which includes metallic compliant member 112, metallic bonding pad 132, and bonding layer 108 at a given contacting site between metallic compliant members 112 metallic bonding pads 132. The metal-to-metal bonding between metallic compliant members 112 and metallic bonding pads 132 is performed at elevated temperatures. The maximum value of the elevated temperature is within a range of 20–500 degrees Celsius. In this particular embodiment, the maximum temperature is about 350 degrees Celsius. A bonding force is applied between metallic compliant members 112 and metallic bonding pads 132. This is done by applying a load to opposed edge 109 of structure 110, as indicated by the downward-pointing arrows in FIG. 7. A suitable load includes a mass which provides about 80–350 grams per ball-bond; in this particular embodiment, this results in a load of about 160–700 grams per structure 110. In this particular embodiment, structures 110 are individually attached. The temperature and force conditions specified above are easily withstood by member 104. The value of the bonding force depends upon bonding area and is readily determined by one skilled in the art. The calculation is based upon the particular geometry of the metallic compliant members and the bonding area. Concurrent with the application of the bonding force, compliant regions 152 are heated, thereby deforming compliant regions 152 and forming metal-to-metal bonds. The deformation at the points of physical contact between metallic compliant members 112 and metallic bonding pads 132 cause surface oxides on the aluminum to be broken, allowing bonding between the gold and aluminum metals. In other embodiments of the present method, the metals employed do not exhibit surface oxidization, so that the deformation requirement is not as important as for this particular embodiment. In yet other embodiments of the present method, ultrasonic or thermosonic bonding can be employed, wherein either structure 110 or modified anode 130 is clamped to an ultrasonic horn which vibrates at about 60 kHz during the contacting step. Given the above values for the temperature and bonding force, the bonding time is about 5–10 seconds, upon application of the full bonding force. After this bonding time has elapsed, the vacuum hold is released and the bonding force, or load, is retracted. Each subsequent spacer 102 is similarly attached. Uniformity among spacers 102 of the height between opposed edge 109 and the inner surface of modified anode 130 can be achieved during the process for bonding structure 110 to modified anode 130. This is done by gauging the distance between opposed edge 109 and the inner surface of modified anode 130 during the bonding step, and retracting the applied load when a predetermined value of the distance is realized. Then compliant region 152 is allowed to cool to ambient temperature, thereby hardening compliant region 152 so that it retains its plastically deformed configuration throughout subsequent display fabrication steps. In the preferred embodiment, uniformity of this distance is achieved during subsequent packaging steps in the assembly of the display, as will be described in greater detail below with reference to FIG. 8. The compliance of compliant regions 152 allows the accommodation of tolerances in the heights of members 104 and the accommodation of fine particulates lodged between the edges of members 104 and the display plates, while providing uniform spacing between the display plates.

Figure 8:
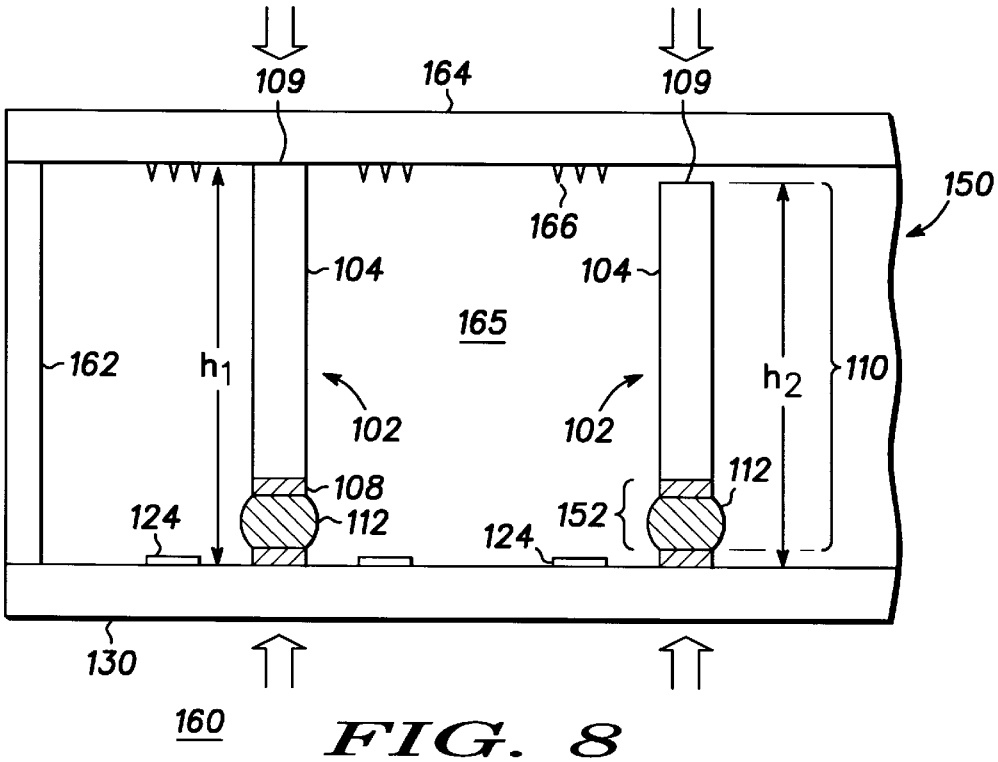
FIG. 8 is a cross-sectional view of a structure realized by performing various steps of an embodiment of a method upon the structure of FIG. 7 in accordance with the present invention.

Referring now to FIG. 8, there is depicted a cross-sectional view of a portion of a field emission display 160 realized by performing various steps of an embodiment of a method upon structure 150 of FIG. 7 in accordance with the present invention. In this particular embodiment, structures 110 are affixed to modified anode 130, without deliberately providing, during the bonding step, the requisite uniformity in the distance between opposed edges 109 and the inner surface of modified anode 130. This uniformity is achieved during packaging steps subsequent to the spacer affixation steps. Field emission display 160 is fabricated by first forming structure 150 wherein compliant regions 152 have been deformed, but not fully compressed, and members 104 remain upright on modified anode 130. Then, a cathode 164 is positioned to oppose modified anode 130, and a plurality of side walls 162 are provided between modified anode 130 and cathode 164 at their perimeters so that an envelope 165 is formed. Spacers 102 are contained in envelope 165. Cathode 164 includes a plurality of field emitters 166, which are schematically represented in FIG. 8. Field emitters 166 are in registration with pixels 124 of modified anode 130 so that, during the operation of field emission display 160, electrons emitted from field emitters 166 are received by pixels 124. For ease of understanding, only two spacers 102 are illustrated in FIG. 8, and the distances, $h_1$ and $h_2$, between each of their opposed edges 109 and the inner surface of modified anode 130 differ, thereby representing the variation that exists in this distance when a predetermined number of spacers 102 are affixed to modified anode 130 in the manner described with reference to FIG.7. In this configuration, cathode 164 is in abutting engagement with only a portion of spacers 102. The weight of cathode 164 is therefore not uniformly loaded over spacers 102, and, if envelope 165 were to be evacuated, the differential pressure thereby created would not be uniformly loaded over spacers 102. This would cause stress risers in modified anode 130 and/or cathode 164 as well as in spacers 102. The stress risers make field emission display 160 susceptible to breakage. In order to provide uniform loading over spacers 102, field emission display 160 is heated to a temperature between 250–500 degrees Celsius by, for example, placing field emission display 160 on a heated chuck or in an oven. Then, a suitable deforming load is provided by the weight of cathode 164, by the differential pressure created upon evacuation of envelope 165, and/or by an additional mass being loaded upon cathode 164. The deforming load is indicated by arrows in FIG. 8. The deforming load causes spacers 102 which are initially touching cathode 164 to be pushed into their corresponding compliant regions 152, which have been softened by the elevated temperature conditions. These compliant regions 152 are thereby plastically deformed until spacers 102, which had not initially made physical contact with cathode 164, are in abutting engagement with cathode 164 at their edges 109. Also, due to deflection of modified anode 130 and/or cathode 164, some spacers 102 will initially bear a greater load than others. These spacers 102 which initially bear a greater load will be pushed to a greater extent, resulting in less pronounced deflection of the display plates. It will be noted that the number, and layout, of spacers 102 is predetermined so that, given a uniform distance among all of spacers 102 between opposed edges 109 and the inner surface of modified anode 130, spacers 102 adequately bear the differential pressure across field emission display 160, and spacers 102 prevent deleterious, excessive deflection of modified anode 130 and cathode 164. For display plates including glass that is 1.1 mm thick, a spacer pitch of about 15 mm is believed to be a suitable layout. For a 10-inch diagonal display a suitable number of spacers 102 is within a range of about 100–200. The geometry as well as the material properties of compliant regions 152 allow plastic deformation to a suitable extent to provide physical contact between the inner surface of cathode 164 and edges 109 of all of members 104, while preventing the spread of material over pixels 124. In this particular embodiment, as metallic compliant members 112 progress from a quasi-spherical shape to a flattened ball, the required applied force to achieve a given amount of compression increases. The behavior of compliant regions 152 is such that compression, or plastic deformation, ceases after all of edges 109 are in abutting engagement with the inner surface of cathode 164 and when modified anode 130 and cathode 164 no longer exhibit deleterious, excessive deflection in order to make this contact with spacers 102. The low yield stress of gold and the ease of deformation due to the spherical shape of metallic compliant member 112, provide a low yield force for a given temperature. The temperature is then controlled to achieve the final configuration described above. This behavior is in contrast to that of glass frit or of glass or ceramic spacers themselves, which do not yield adequately to accommodate the height tolerances in the spacers. The uniform loading of spacers 102 can be achieved prior to the evacuation of envelope 165 or during the evacuation of envelope 165.

Figure 9:
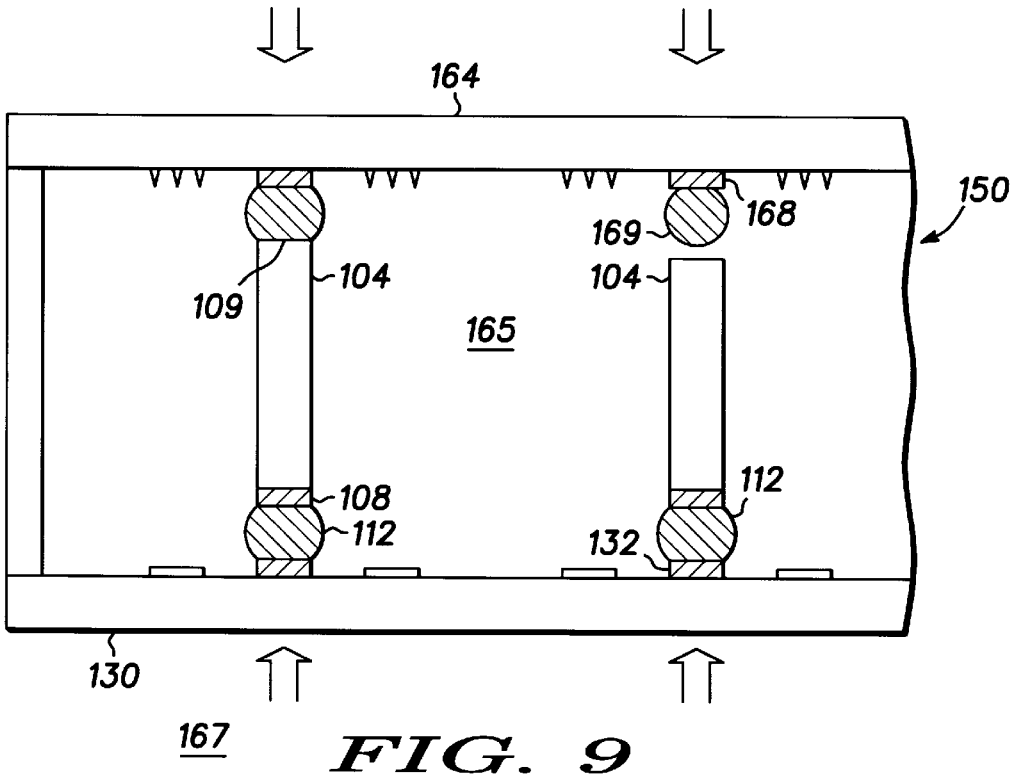
FIG. 9 is a cross-sectional view, similar to FIG. 8, of a structure realized by performing various steps of another embodiment of a method in accordance with the present invention.

Referring now to FIG. 9, there is depicted a cross-sectional view, similar to FIG. 8, of a field emission display 167, which includes all the elements of field emission display 160 of FIG. 8. Field emission display 167 further includes a plurality of metallic bonding pads 168, which are formed on cathode 164, and a plurality of metallic compliant members 169, which are affixed to metallic bonding pads 168 in a manner similar to the bonding between metallic compliant members 112 and metallic bonding pads 132. Metallic compliant members 169 are placed in physical contact with edges 109 of members 104; no bonding layer is required on edge 109 and no bond is required between edge 109 and metallic compliant member 169. Metallic compliant member 169 provides compliance between member 104 and cathode 164 and prevents the breakage and chipping of member 104 and/or the display plates. In another embodiment of a flat panel display in accordance with the present invention, a metallic compliant member includes a layer of metal being deposited on the regions of the inner surface of one of the display plates with which the uncoated edge of member 104 makes contact. The layer of metal includes a compliant metal, such as aluminum or gold, and has a thickness of at least 1 micrometer to provide adequate compliance. Member 104 is held upright by other means at the edge opposite the uncoated edge, and the compliant metal layer is placed in abutting engagement with the uncoated edge, thereby reducing stress risers which can otherwise occur due to the contact between the hard, uncoated edge of member 104 and the hard surface of the abutting display plate. Stress risers are common because these surfaces/edges are typically not completely flat or smooth.

Figure 10:
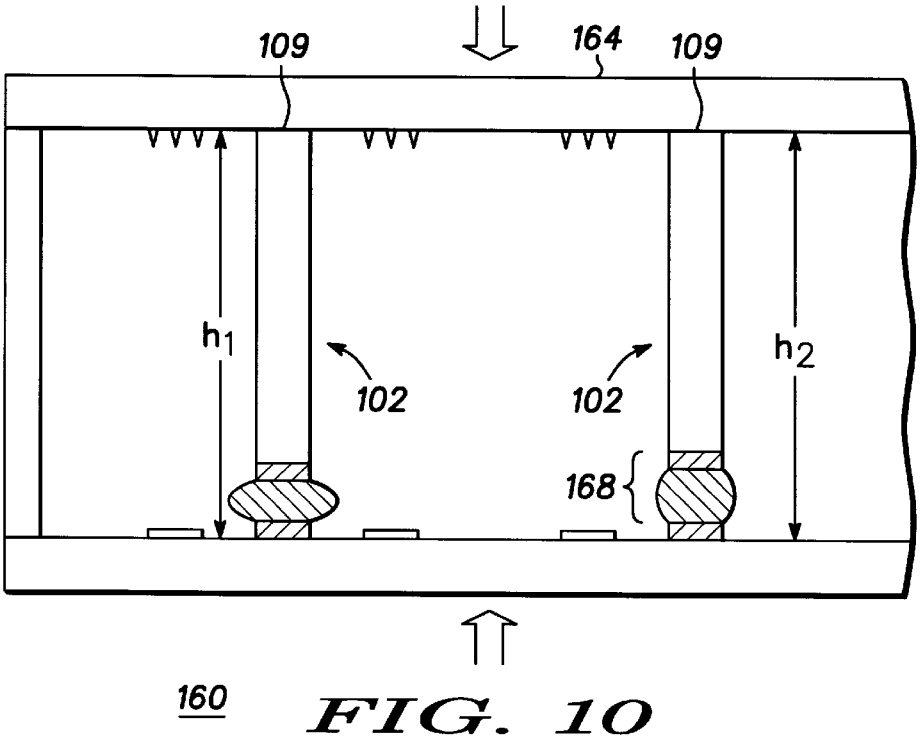
FIG. 10 is a cross-sectional view, similar to FIG. 8, of a structure realized by performing various steps of an embodiment of a method upon the structure of FIG. 8 in accordance with the present invention.

Referring now to FIG. 10, there is depicted a cross-sectional view of field emission display 160 of FIG. 8 after the step of equalizing the distances $h_1$ and $h_2$. When cathode 164 is in abutting engagement with all of opposed edges 109 of spacers 102, the differential pressure across field emission display 160, represented by arrows in FIG. 10, is uniformly loaded over spacers 102. After compliant regions 152 are cooled and hardened into the configurations which provide the uniform loading, a plurality of load transmission regions 168 are provided at the locations of compliant regions 152. Because the metals of load transmission regions 168 are not brittle, they do not contribute to particulate formation within field emission display 160.

In other embodiments of a method in accordance with the present invention, spacers 102 are affixed to cathode 164. The steps of these embodiments are similar to those described above with reference to affixation of spacers 102 to modified anode 130. However, the elevated-temperature bonding, such as thermocompression or thermosonic bonding, must be performed in a vacuum in order to prevent the oxidation of the gate/extraction metal and the oxidation of field emitters 166, which are typically made from molybdenum. Other metal-to-metal bonding techniques, such as ultrasonic bonding, can be employed to prevent oxidation of field emitters 166 during the affixation of spacers 102 onto cathode 164.

Figure 11:
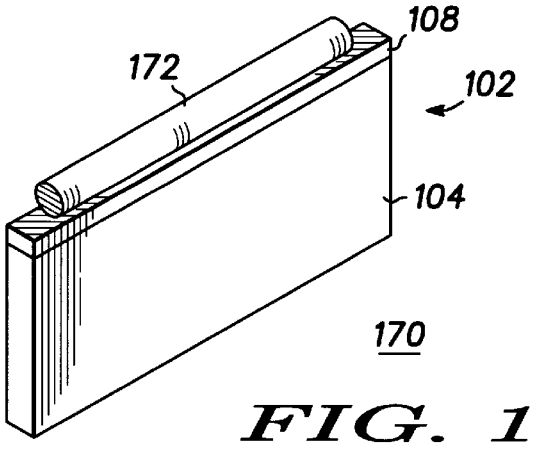
FIG. 11 is an isometric view of a structure realized by performing various steps of another embodiment of a method for affixing spacers in a flat panel display in accordance with the present invention.

Referring now to FIG. 11, there is depicted an isometric view, similar to FIG. 2, of a structure 170 realized by performing various steps of another embodiment of a method in accordance with the present invention. Structure 170 includes member 104, bonding layer 108, and a metallic compliant member 172 which includes a length of metal wire being made from a compliant metal, such as gold or aluminum. The length of wire has a diameter within a range of 10–100 micrometers. Metallic compliant member 172 is affixed to bonding layer 108 by using standard wire-bonding techniques. Then, to make a field emission display, structure 170 is affixed to modified anode 130, in a manner similar to that described with reference to FIGS. 7–9.

Figure 12:
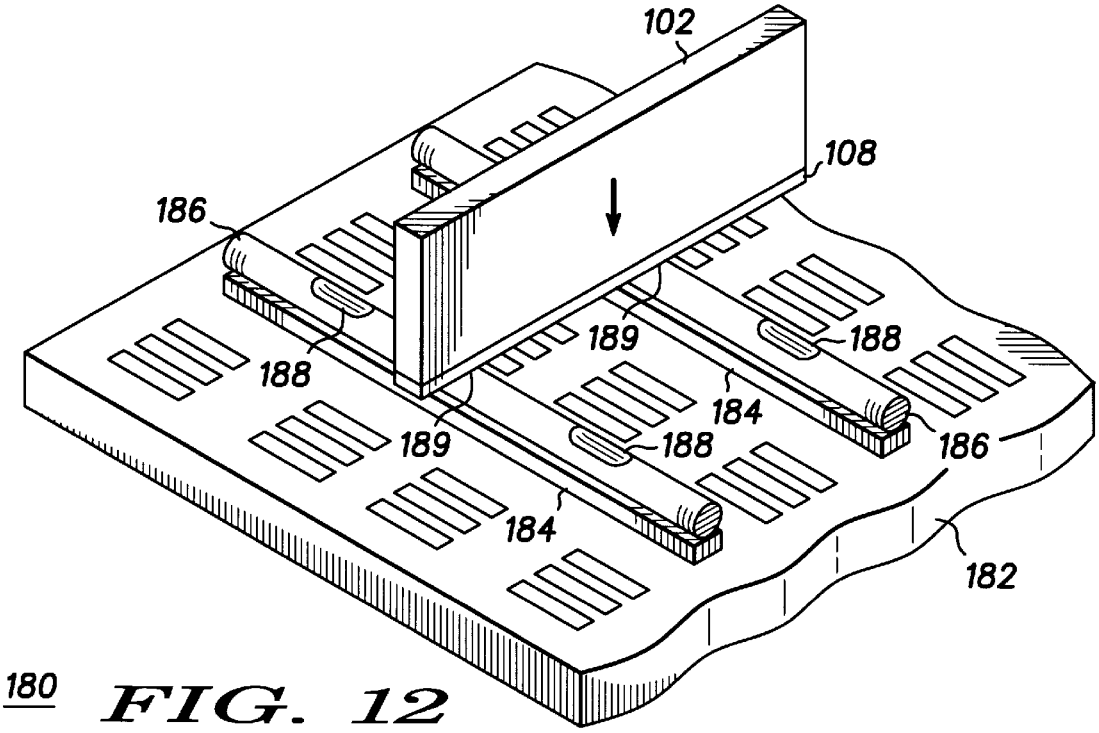
FIG. 12 is an isometric view of a structure realized by performing various steps of another embodiment of a method for affixing spacers in a flat panel display in accordance with the present invention.

In other embodiments of a method in accordance with the present invention, the metallic compliant member is first bonded to the inner surface of one of the display plates, and then the spacer, having the bonding layer formed thereon, is bonded to the metallic compliant member. Illustrated in FIG. 12 is an isometric view of a portion of a structure 180 realized by performing various steps of one such embodiment. Structure 180 includes a modified anode 182 having a plurality of metallic bonding pads 184, which are provided in a manner similar to that described with reference to FIGS. 5 and 6. Adjacent metallic bonding pads 184, if in the form of discrete strips, are about 3–4 mm apart in order to accommodate spacers 102 which are about 5 mm long and are positioned perpendicularly with respect to metallic bonding pads 184. After metallic bonding pads 184 are formed on modified anode 182, a plurality of metallic compliant members 186, including lengths of gold or aluminum wire, are bonded by a metal bonding technique, such as thermocompression, to metallic bonding pads 184. During this step a plurality of compressed regions 188 are formed in metallic compliant members 186. Then, bonding layer 108 of spacer 102 is placed in abutting engagement with metallic compliant members 186 at locations 189 which are not compressed. Locations 189 are more favorable for bonding because of the greater degree of curvature. Spacer 102 is then bonded to metallic compliant members 186 in a similar manner as described with reference to FIG. 7.

Figure 13:
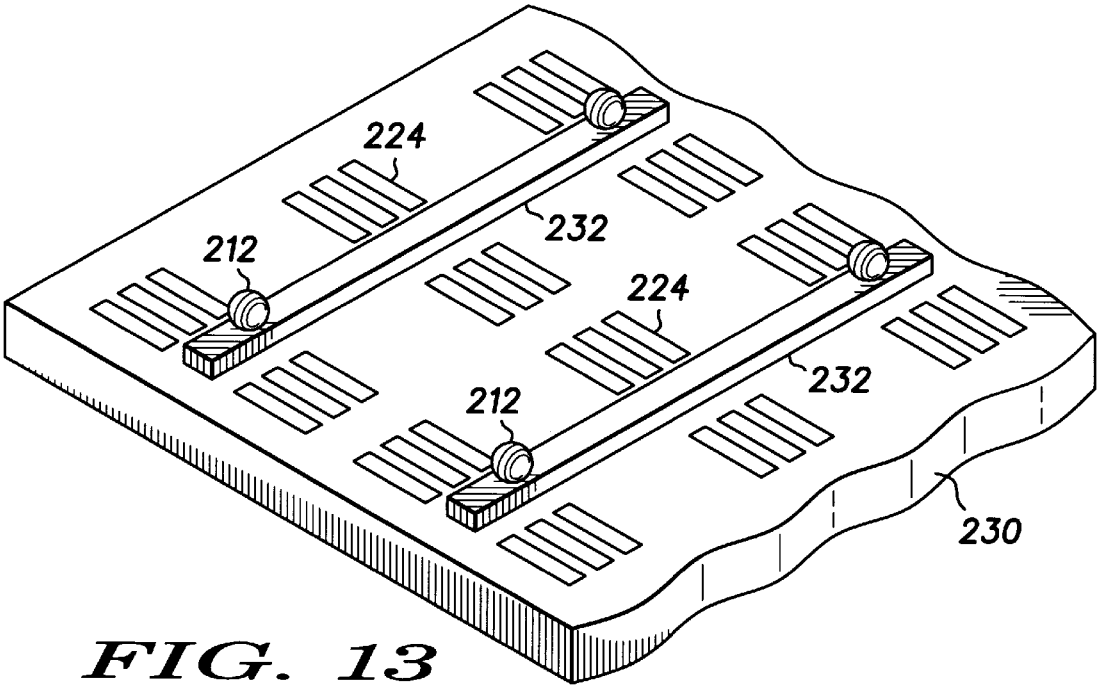
Figure 15:
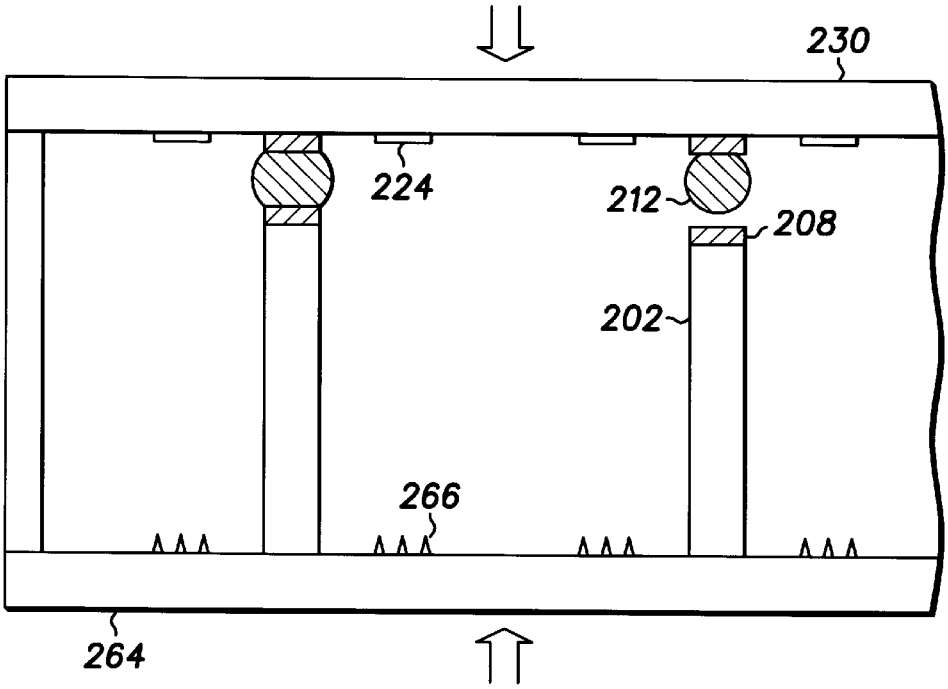
FIG. 15 is a cross-sectional view of the structure depicted in FIG. 14.

Referring now to FIGS. 12–15, there are depicted isometric and cross-sectional views of structures realized by performing various steps of another embodiment of a method for affixing a plurality of spacers 202 within a field emission display 260 in accordance with the present invention. Referring now to FIG. 13, there is illustrated a portion of a modified anode 230 having a plurality of metallic bonding pads 232 being formed thereon, between a plurality of pixels 224. Metallic bonding pads 232 are made from aluminum. A plurality of metallic compliant members 212, including gold balls, are affixed to metallic bonding pads 232 by using standard gold ball-bonding equipment. Referring now to FIG. 14 there is depicted the affixation of spacers 202 to modified anode 230 at metallic compliant members 212. Field emission display 260, a portion of which is depicted in FIG. 14, includes a cathode 264 on which spacers 202 have been previously formed. Several methods exist for forming spacers 202 on cathode 264. One such scheme is disclosed is U.S. Pat. No. 5,232,549 issued Aug. 3, 1993, which is hereby incorporated by reference. The method described therein includes forming a patterned layer of aluminum on an insulator layer which has been deposited on the inner surface of cathode 264. The aluminum defines configuration of spacers 202. After spacers 202, which may include posts, are formed by laser ablation of the insulator layer, the aluminum remains on the tops of spacers 202. In this particular embodiment of a method in accordance with the present invention, this residual layer of aluminum comprises a bonding layer 208 to which metallic compliant members 212 are bonded by, for example, thermocompression in a vacuum environment. In this particular embodiment, the present method primarily provides compliance to achieve uniform loading in a manner similar to that described with reference to FIGS. 8 and 9; this particular embodiment is not providing the perpendicularity of spacers 202 with respect to modified anode 230 and cathode 264. Considerations, such as materials, spacer geometry, and/or alignment, may make such an embodiment desirable. Referring now to FIGS. 14 and 15, there are depicted cross-sectional views, similar to those of FIGS. 8 and 9, of field emission display 260, during the steps of providing uniform loading of spacers 202, in a manner similar to that described with reference to FIGS. 8, 9 and resulting in a load transmission region 268 at each of spacers 202. In another embodiment of the present invention, spacers 202 do not have bonding layer 208 formed thereon, and metallic compliant members 212 are placed in abutting engagement with the upper edges of spacers 202 to provide compliance between spacers 202 and modified anode 230, in a manner analogous to the compliance provided between metallic compliant members 169 and members 104 as described with reference to FIG. 9.

Referring now to FIG. 17, there is depicted a cross-sectional view of a structure 350 realized by performing various steps of another embodiment of a method for affixing a plurality of spacers 302 within a flat panel display. Structure 350 includes a modified anode 330 having deposited thereon a plurality of metallic bonding pads 332 being made of a suitable metal such as aluminum and having a thickness of about 1 micrometer. Spacers 302 include a member 304 being made from a suitable dielectric material, such as ceramic. Each of spacers 302 has a bonding layer 308 being deposited on one edge, including a suitable bonding metal, such as gold, and having a thickness of about 1 micrometer. Bonding layer 308 is bonded to metallic bonding pad 332 by a suitable metal bonding technique, such as thermocompression, including the application of a bonding force, as represented by an arrow in FIG. 17, and concurrent heating to a temperature within a range of 20–500 degrees Celsius. In this particular embodiment of the present method, spacers 302 have a highly uniform height. The uniformity is good enough that very little compliance is required, and the metal-to-metal bonding affixes spacers 302 to modified anode 330 so that spacers 302 retain their perpendicularity with respect to modified anode 330 during subsequent packaging steps of the display.

What is claimed is:

1. A method for affixing a plurality of spacers within a flat panel display having first and second display plates, the method including the steps of:

providing a plurality of members, the plurality of members having a uniform height within a range of 0.5–3 millimeters, having a width within a range of 25–250 micrometers, being made from a dielectric material, and having first and second edges;

coating the first edge of each of the plurality of members with a metal to provide a bonding layer;

forming a metallic bonding pad on an inner surface of the first display plate;

physically contacting the bonding layer with the metallic bonding pad; and applying pressure between the bonding layer and the metallic bonding pad thereby forming a metallic bond between the bonding layer and the metallic bonding pad.

2. A method for affixing a plurality of spacers as claimed in claim 1 further including the step of heating the bonding layer and the metallic bonding pad to a temperature within a range of 20–500 degrees Celsius, the step of heating occurring concurrent with the step of applying pressure.

3. A method for affixing a plurality of spacers within a flat panel display having first and second display plates, the method including the steps of:

providing a plurality of members, the plurality of members having a uniform height within a range of 0.1–3 millimeters, having a width within a range of 25-250 micrometers, being made from a dielectric material, and having first and second edges;

coating the first edge of each of the plurality of members with a metal to provide a first bonding layer;

forming a metallic bonding pad on an inner surface of the first display plate;

providing a metallic compliant member;

forming a first metallic bond between the metallic compliant member and the first bonding layer; and forming a second metallic bond between the metallic compliant member and the metallic bonding pad thereby providing a compliant region between the first edge and the inner surface of the first display plate.

4. A method for affixing a plurality of spacers as claimed in claim 3 wherein the first bonding layer is made from a metal being selected from a group consisting of gold and aluminum.

5. A method for affixing a plurality of spacers as claimed in claim 3 wherein the metallic bonding pad is made from a metal being selected from a group consisting of gold and aluminum.

6. A method for affixing a plurality of spacers as claimed in claim 3 wherein the metallic compliant member is made from a metal being selected from a group consisting of gold and aluminum.

7. A method for affixing a plurality of spacers as claimed in claim 3 wherein the metallic compliant member includes a ball.

8. A method for affixing a plurality of spacers as claimed in claim 7 wherein the ball has a diameter within a range of 25–200 micrometers.

9. A method for affixing a plurality of spacers as claimed in claim 3 wherein the metallic compliant member includes a length of wire.

10. A method for affixing a plurality of spacers as claimed in claim 9 wherein the length of wire has a diameter within a range of 10–100 micrometers.

11. A method for affixing a plurality of spacers as claimed in claim 3 wherein the dielectric material of the plurality of members is selected from a group consisting of ceramic, glass-ceramic, glass, and quartz.

12. A method for affixing a plurality of spacers as claimed in claim 3 wherein each of the plurality of members has a length within a range of 1–100 millimeters.

13. A method for affixing a plurality of spacers as claimed in claim 3 wherein the first display plate includes an anode and wherein the step of forming the metallic bonding pad on the inner surface of the first display plate includes forming on the inner surface of the anode a layer of aluminum having a thickness of at least 3000 Angstroms.

14. A method for affixing a plurality of spacers as claimed in claim 3 wherein the step of forming the first metallic bond between the metallic compliant member and the first bonding layer includes the steps of:

physically contacting the metallic compliant member with the first bonding layer to provide a contacting region;

applying heat to the contacting region; and applying a force over the metallic compliant member and the first bonding layer thereby deforming the contacting region to form the first metallic bond.

15. A method for affixing a plurality of spacers as claimed in claim 3 wherein the step of forming the second metallic bond between the metallic compliant member and the metallic bonding pad includes the steps of:

physically contacting the metallic compliant member with the metallic bonding pad to provide a compliant region including the metallic compliant member, the metallic bonding pad, and the first bonding layer;

applying heat to the compliant region; and applying a force over the plurality of members and the first display plate to deform the compliant region and form the second metallic bond.

16. A method for affixing a plurality of spacers as claimed in claim 3 further including the steps of:

positioning the second display plate in parallel spaced relationship with the first display plate so that the inner surface of the second display plate is in abutting engagement with a portion of the plurality of members;

providing side walls between the first and second display plates at their perimeters to provide an envelope;

evacuating the envelope thereby applying a load to said portion of the plurality of spacers;

heating the compliant regions thereby providing deformation of the compliant regions until the inner surface of second display plate is in abutting engagement with the second edges of substantially all of the plurality of spacers so that a predetermined spacing is provided between the inner surfaces of the first and second display plates; and thereby hardening the compliant regions to provide a plurality of load transmission regions at the locations of the compliant regions so that the differential pressure across the flat panel display is uniformly loaded over the plurality of spacers.

17. A method for affixing a plurality of spacers as claimed in claim 3 further including the step of deforming the compliant region to a sufficient extent so that the perpendicular distance between the inner surface of the first display plate and the second edge of each of the plurality of spacers is equal to a predetermined spacing between the inner surfaces of the first and second display plates of the flat panel display so that, when the inner surface of the second display plate is subsequently placed in abutting engagement with the second edges of the plurality of spacers, the inner surface of the second display plate makes physical contact with substantially all of the plurality of spacers thereby providing uniform loading over the plurality of spacers.

18. A method for affixing a plurality of spacers as claimed in claim 3 wherein the plurality of spacers have a height tolerance of up to 35 micrometers.

19. A method for affixing a plurality of spacers as claimed in claim 3 wherein the step of providing a metallic compliant member includes the step of selectively electroplating a metal onto the first bonding layer.

20. A method for affixing a plurality of spacers as claimed in claim 3 wherein the step of providing a metallic compliant member includes the step of selectively plating a metal onto the first bonding layer by using an electroless plating solution.

21. A method for affixing a plurality of spacers as claimed in claim 3 further including the steps of:

providing a second metallic compliant member;

forming a second metallic bonding pad on an inner surface of the second display plate;

forming a metallic bond between the second metallic compliant member and the second metallic bonding pad; and placing the second metallic compliant member in abutting engagement with the second edge of one of the plurality of members thereby providing a compliant region between the second edge and the inner surface of the second display plate.

22. A flat panel display including:

a first display plate having an inner surface;

a second display plate having an inner surface opposing and being spaced apart from the inner surface of the first display plate;

a spacer having first and second edges, the first edge physically contacting the inner surface of the first display plate so that the spacer is disposed perpendicularly with respect to the first display plate, the spacer having a height within a range of 0.1–3 millimeters and a width within a range of 25–250 micrometers; and a metallic compliant member being disposed between the second display plate and the second edge of the spacer, the metallic compliant member physically contacting the spacer and the inner surface of the second display plate, the inner surface of the second display plate being spaced from the second edge of the spacer to provide a spacing of at least 1 micrometers whereby the metallic compliant member provides compliance between the second display plate and the second edge of the spacer and prevents chipping and breakage of the spacer and of the first and second display plates.

23. A flat panel display as claimed in claim 22 wherein the metallic compliant member is made from a metal being selected from a group consisting of gold and aluminum.

24. A flat panel display as claimed in claim 22 wherein the metallic compliant member includes a gold ball.

25. A flat panel display as claimed in claim 22 further including a second metallic compliant member being disposed between the first display plate and the first edge of the spacer and being in physical contact with the first display plate and the first edge of the spacer whereby the second metallic compliant member provides compliance between the first display plate and the first edge of the spacer and prevents chipping and breakage of the spacer and of the first and second display plates.

* * * * *

UNITED STATES PATENT AND TRADEMARK OFFICE

CERTIFICATE OF CORRECTION

PATENT NO. : 5,811,927

DATED : September 22, 1998

INVENTOR(S) : Clifford L. Anderson and Curtis D. Moyer

It is certified that error appears in the above-identified patent and that said Letters Patent is hereby corrected as shown below:

In column 13, claim 16, line 48, insert --thereafter cooling the envelope to room temperature-- before "thereby hardening the compliant regions..."

Signed and Sealed this

Second Day of March, 1999

*Attest:*

*Attesting Officer*

Q. TODD DICKINSON

*Acting Commissioner of Patents and Trademarks*